US008096450B2

(12) United States Patent
Herry et al.

(10) Patent No.: US 8,096,450 B2
(45) **Date of Patent: *Jan. 17, 2012**

(54) LATERAL ACTUATION SPRAY DEVICE

(75) Inventors: Serge Herry, Quatremare (FR); Ludovic Petit, Vitot (FR)

(73) Assignee: Valois S.A.S., Le Neubourg (FR)

( * ) Notice: Subject to any disclaimer, the term of this patent is extended or adjusted under 35 U.S.C. 154(b) by 1278 days.

This patent is subject to a terminal disclaimer.

(21) Appl. No.: 10/496,147

(22) PCT Filed: Nov. 19, 2002

(86) PCT No.: PCT/FR02/03954

§ 371 (c)(1),
(2), (4) Date: Oct. 21, 2004

(87) PCT Pub. No.: WO03/043909

PCT Pub. Date: May 30, 2003

(65) Prior Publication Data

US 2005/0040188 A1 Feb. 24, 2005

(30) Foreign Application Priority Data

Nov. 20, 2001 (FR) ..... 01 15003

(51) Int. Cl.
*B65D 83/00* (2006.01)

(52) U.S. Cl. ..... 222/402.11; 222/321.6; 222/321.1; 222/321.8; 222/321.9; 222/402.15; 239/333; 239/331; 239/329

(58) Field of Classification Search ..... 239/318, 239/360, 375, 418, 329, 331, 333, 482; 222/162, 222/321.6, 321.8, 321.9, 402.13, 402.15, 402.11, 321.7, 321.1

See application file for complete search history.

(56) References Cited

U.S. PATENT DOCUMENTS 3,272,391 A * 9/1966 Meshberg ..... 222/162
3,323,690 A * 6/1967 Monahon ..... 222/402.13
3,379,381 A * 4/1968 Decaux ..... 239/333
3,726,444 A * 4/1973 Ostrowsky et al. ..... 222/402.11
3,726,445 A * 4/1973 Ostrowsky et al. ..... 222/402.11
3,888,392 A * 6/1975 Van Coney ..... 222/108

(Continued)

FOREIGN PATENT DOCUMENTS

DE 196 10 456 A1 9/1997

(Continued)

OTHER PUBLICATIONS

Patent Abstracts of Japan vol. 1998, No. 12, Oct. 31, 1998.

*Primary Examiner* — Len Tran
*Assistant Examiner* — Trevor E McGraw
(74) *Attorney, Agent, or Firm* — Sughrue Mion, PLLC

(57) ABSTRACT

A fluid spray device comprising a reservoir (10) containing fluid; a pump or a valve (20) mounted on the reservoir (10) by means of a fixing ring (30) for selectively dispensing the fluid; and a dispenser head (40) including a dispenser orifice (45), the device further comprising an actuator device (50) that is displaceable between a rest position and a dispensing position, the actuator device (50) being displaced in a direction that is different from the direction in which the fluid is sprayed through the dispenser orifice (45), said fluid spray device being characterized in that said actuator device (50) is formed on the dispenser head (40), and co-operates with the fixing ring (30), or with an element secured thereto, in order to actuate the pump or the valve (20).

22 Claims, 4 Drawing Sheets

U.S. PATENT DOCUMENTS

| | | | | | |
|---|---|---|---|---|---|
| 4,033,487 | A | * | 7/1977 | Micallef | 222/207 |
| 4,077,549 | A | * | 3/1978 | Beard | 222/321.8 |
| 4,264,038 | A | * | 4/1981 | Nozawa | 239/333 |
| 4,271,990 | A | * | 6/1981 | Kutik et al. | 222/321.8 |
| 4,640,493 | A | * | 2/1987 | Dudzik | 251/342 |
| 5,139,180 | A | * | 8/1992 | Lucas | 222/402.13 |
| 5,230,447 | A | * | 7/1993 | Kirk | 222/505 |
| 5,370,313 | A | * | 12/1994 | Beard | 239/337 |
| 5,950,877 | A | * | 9/1999 | Garcia et al. | 222/190 |
| 5,971,226 | A | * | 10/1999 | Goncalves | 222/321.6 |
| 5,988,870 | A | * | 11/1999 | Partsky | 366/348 |
| 6,193,115 | B1 | * | 2/2001 | Das | 222/401 |
| 6,412,659 | B1 | * | 7/2002 | Kneer | 222/82 |
| 6,419,124 | B1 | * | 7/2002 | Hennemann et al. | 222/321.6 |
| 6,588,631 | B2 | * | 7/2003 | Sanchez | 222/402.13 |
| 6,964,381 | B2 | * | 11/2005 | Stradella et al. | 239/333 |
| 2004/0262339 | A1 | * | 12/2004 | Stradella | 222/633 |

FOREIGN PATENT DOCUMENTS

| | | | | |
|---|---|---|---|---|
| JP | 10-179739 | A | | 7/1998 |
| JP | 10 179739 | A | | 7/1998 |
| WO | WO0230577 | | * | 4/2002 |

* cited by examiner

LATERAL ACTUATION SPRAY DEVICE

The present invention relates to a fluid spray device, and more particularly to a fluid spray device in which the actuation force exerted by the user is directed in a direction that is different from the direction in which the fluid is sprayed through the spray orifice of the device.

Most fluid dispenser devices, whether they be perfume, medicine, or cosmetic dispensers, are made in such a manner that the user, when wishing to dispense a dose of fluid, exerts a force either on the dispenser head, or on the fluid reservoir, the force being directed axially in the displacement direction of the piston or of the valve of the device. That type of actuation is very practical for any device in which the spray direction is not axial, i.e. is not parallel to the displacement direction of the piston of the pump or the valve member of the valve of the device. In contrast, for a nasal spray in which the fluid is dispensed axially in order to project the dose of fluid into the nostril, that type of spray presents a certain number of drawbacks.

Thus, in particular, the fact that the force for actuating the device must be exerted in an axial direction implies that it is difficult to hold the nasal endpiece still inside the nostril while dispensing. In addition, that type of actuation can require a certain amount of force to overcome the precompression of the pump or of the valve, which can present difficulties for certain people such as the elderly or children, and which can, in extreme cases, also lead to injury to the inside of the nostril. In addition, that type of device is relatively difficult to actuate by a third person who is unable to sense contact of the nasal endpiece inside the nostril.

Document U.S. Pat. No. 3,272,391 discloses a device in which an external ring is assembled around the fixing element, specifically a clamping ring that is clamped onto the neck of the receptacle. Two laterally-actuated elements co-operate with said external ring in order to actuate the dispenser valve.

An object of the present invention is to provide a fluid spray device which does not reproduce the above-mentioned drawbacks.

In particular, an object of the present invention is to provide a fluid spray device which is simple and inexpensive to manufacture and to assemble, and which can be adapted to any type of presently-available pump or valve, without needing to modify the design of the pump or the valve.

Another object of the present invention is to provide such a fluid spray device which is simple to actuate, in particular in a nasal application.

Another object of the present invention is to provide such a fluid spray device which enables the dispenser orifice of the device to be held still inside the nostril while the device is being actuated.

Another object of the present invention is to provide such a device which limits the number of component parts, and which does not need an add-on element in order to actuate it.

The present invention therefore provides a fluid spray device comprising a reservoir containing fluid; a pump or a valve mounted on the reservoir by means of a fixing ring for selectively dispensing the fluid; and a dispenser head including a dispenser orifice, the device further comprising an actuator device that is displaceable between a rest position and a dispensing position, the actuator device being displaced in a direction that is different from the direction in which the fluid is sprayed through the dispenser orifice, said fluid spray device being characterized in that said actuator device is formed on the dispenser head, and co-operates with the fixing ring in order to actuate the pump or the valve.

Said dispenser head advantageously includes a lateral skirt, said actuator device being formed in said lateral skirt.

In a first embodiment of the present invention, said actuator device includes at least one actuator element pivotally mounted on said dispenser head, and including an actuator portion co-operating with said fixing ring.

Each actuator element advantageously includes a presser element on which the user exerts an actuation force, said presser element being connected to said actuator portion of the actuator element via a connection spacer.

Said actuator device advantageously includes two actuator elements that are diametrally opposite about said dispenser head.

In another embodiment of the present invention, the actuator device is made in the form of one or more buttons co-operating with said fixing ring, said buttons being displaceable in a direction that is approximately perpendicular to the displacement direction of the actuator rod of the pump or of the valve member of the valve.

The fixing ring advantageously includes an oblique cam element co-operating with the bottom end of the lateral skirt of the dispenser head, so that displacement of said skirt transversely to the direction in which the fluid is sprayed is transformed by said oblique cam element into displacement in the direction in which the fluid is sprayed.

The cam element is advantageously provided at the end of the actuating stroke of the dispenser head.

In another embodiment of the present invention, said actuator device includes an actuator element pivotally mounted on said head, said actuator element co-operating with an intermediate piece connected firstly to said head, and secondly to said ring, said intermediate piece being deformable so that said ring can be displaced axially relative to said head during actuation.

In yet another embodiment of the present invention, said actuator device includes at least one actuator element slidably mounted to slide along the lateral skirt of the dispenser head.

The actuator device advantageously includes a precompression element, so that the pump or the valve is actuated only when the precompression threshold is overcome by the user.

The dispenser head is advantageously a nasal dispenser head, which, during actuation of the pump or the valve, remains steady in position in the user's nostril.

Other characteristics and advantages of the present invention appear more clearly from the following detailed description of several embodiments of the present invention, given by way of non-limiting example, and with reference to the accompanying drawings, in which.

Figure 3A:
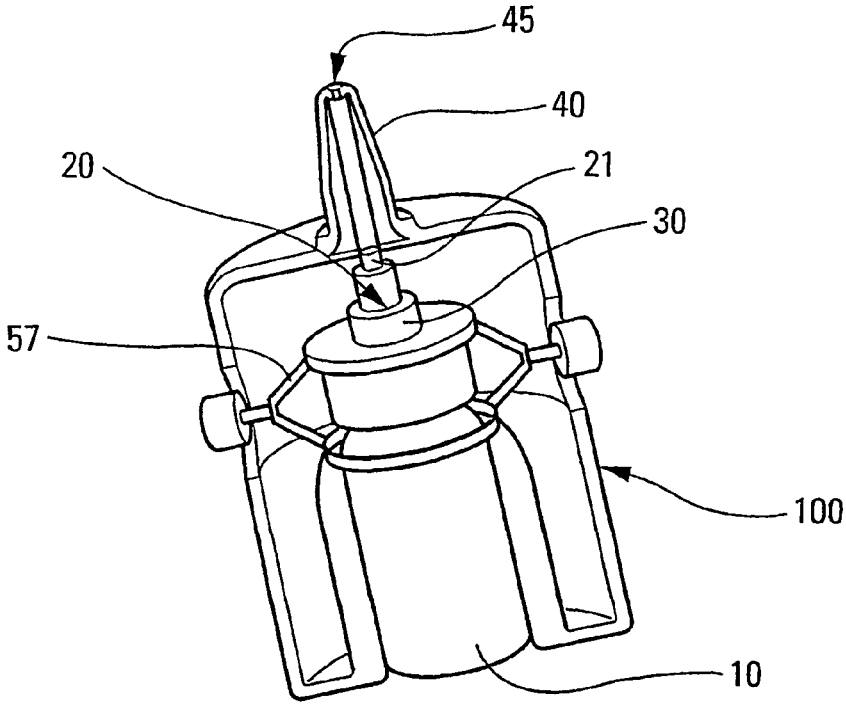
Figure 3B:
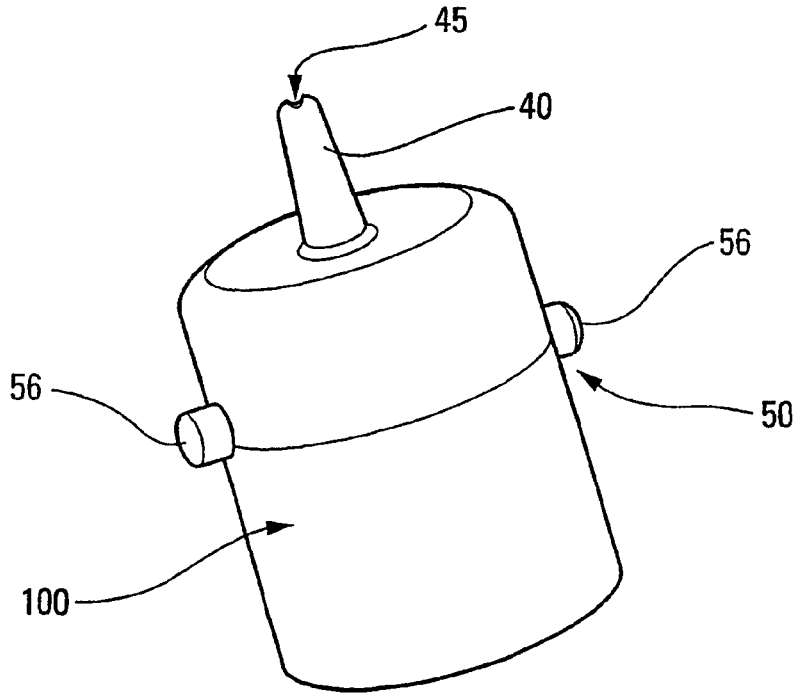
Figure 4:
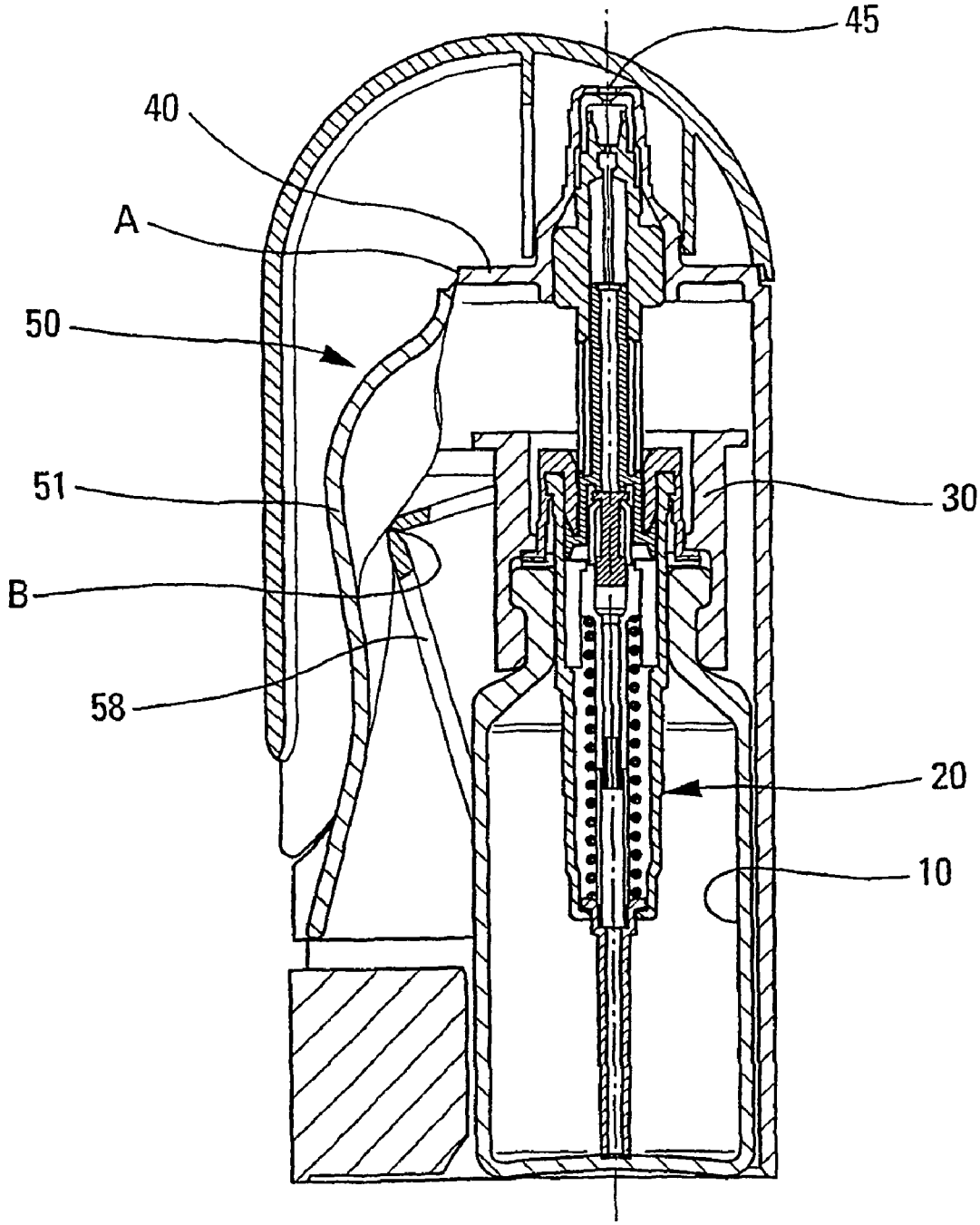

FIGS. 3*a* and 3*b* are diagrammatic views of a device constituting a third embodiment of the present invention; and FIG. 4 is a diagrammatic section view of a device constituting a fourth embodiment of the present invention.

Figure 1:
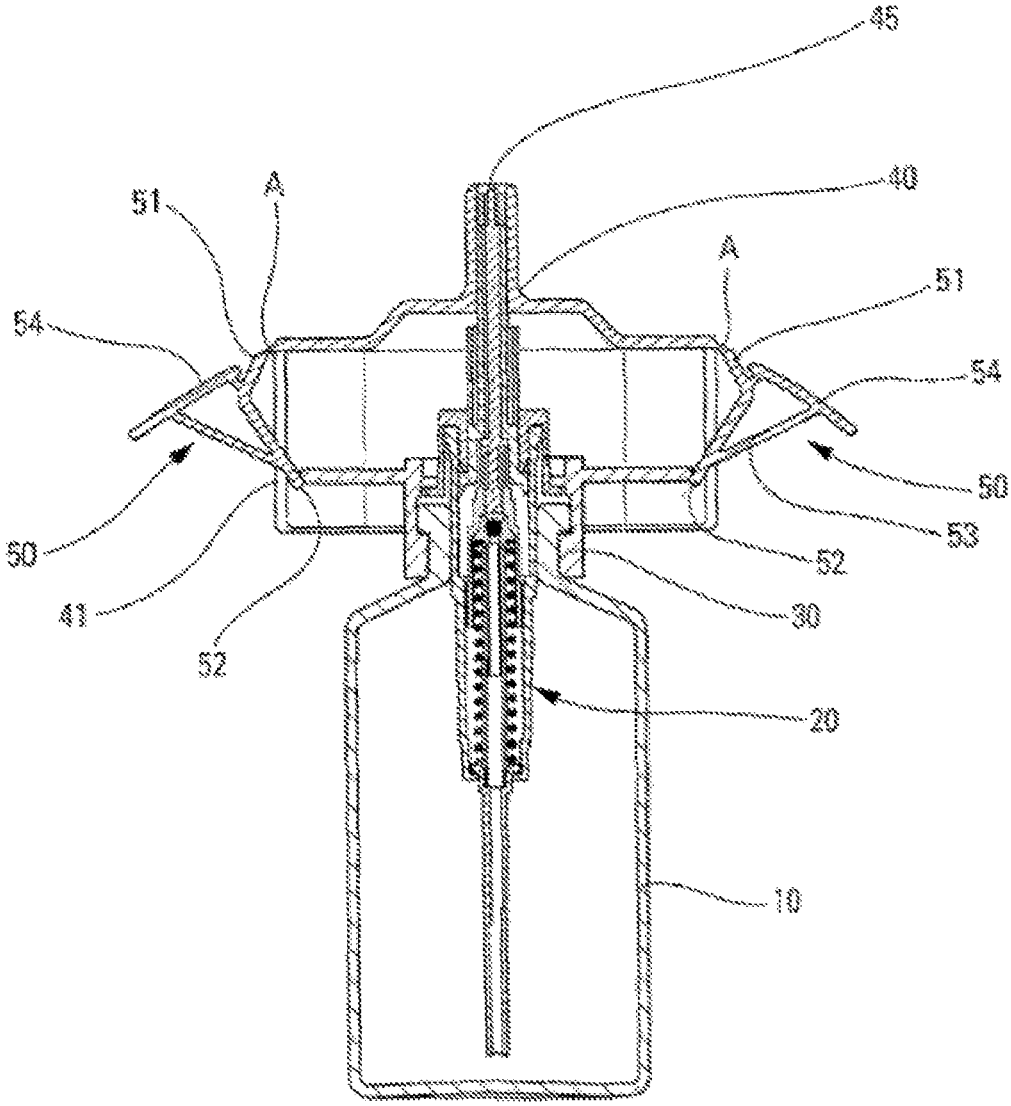
FIG. 1 is a diagrammatic section view of a device constituting a first embodiment of the present invention.
Figure 2:
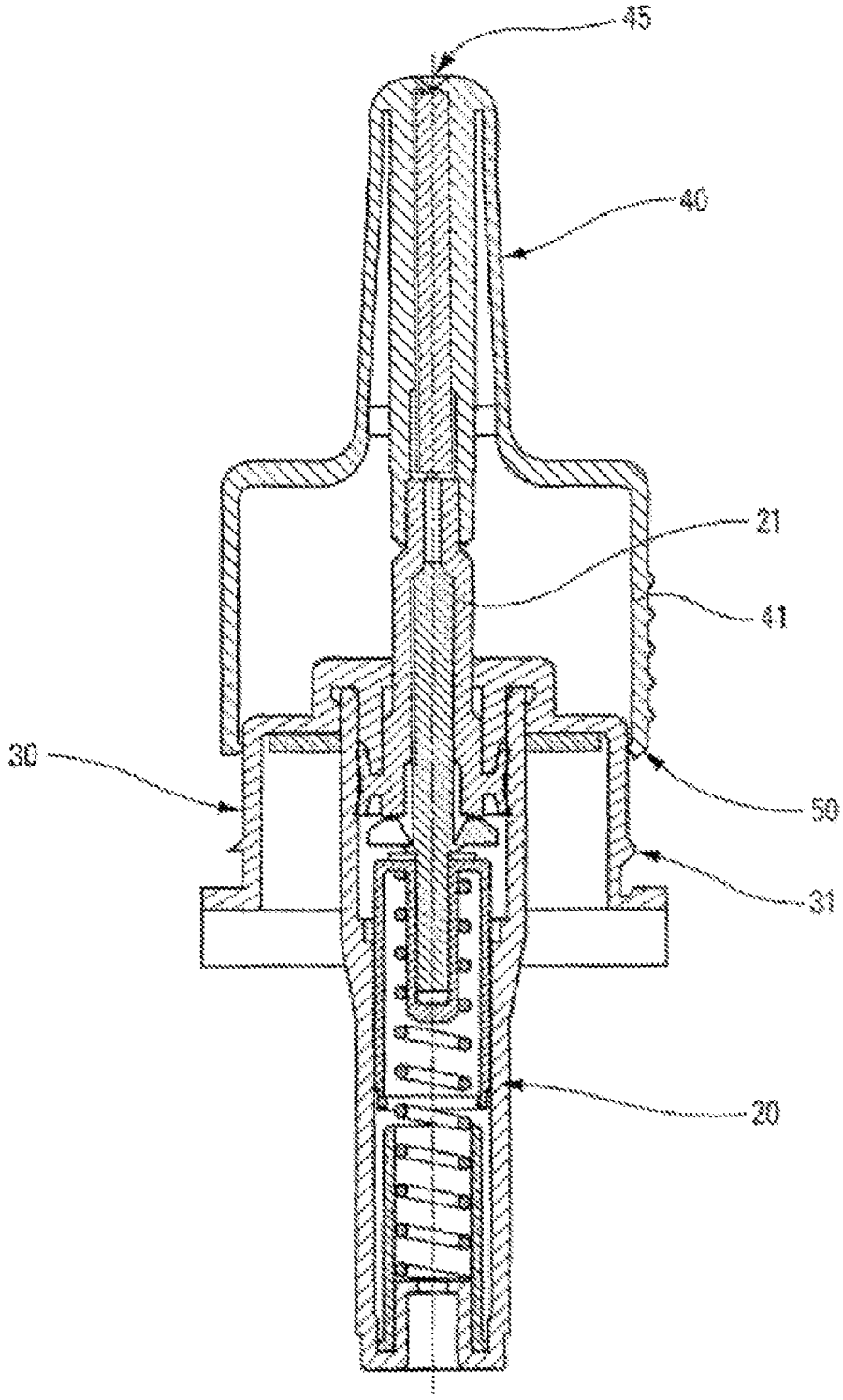
FIG. 2 is a diagrammatic section view of a device constituting a second embodiment of the present invention.

FIGS. 1, 2, and 4 are slightly more detailed views of two variant embodiments of the present invention, while FIGS. 3*a* and 3*b* are very diagrammatic views which show a different embodiment of the actuator device, without showing the rest of the device in detail.

With reference to the figures, and in particular with reference to FIG. 1, the spray device of the invention comprises a reservoir 10 which contains the fluid to be dispensed, and a pump or a valve 20, in this case a pump in FIG. 1 which is mounted on the reservoir 10 by means of a fixing ring 30, which, in this example, is a snap-on ring that is snap-fastened onto the neck of the reservoir. The pump 20 serves to dispense the fluid selectively through a dispenser orifice 45 provided in a dispenser head 40. In this example, as in the examples shown in the other figures, the dispenser head 40 is a nasal dispenser head, in which the orifice 45 is disposed in axial manner in order to dispense the fluid inside the nostril.

Naturally, the present invention is not necessarily limited to a nasal application, but applies to any type of fluid dispenser device. Its use in a nasal-type dispenser device does however present the above-mentioned advantages.

In the invention, the spray device includes an actuator system 50 which is formed on the dispenser head 40, the displacement direction of the actuator device 50 being different from the direction in which the fluid is sprayed through the dispenser orifice 45. More specifically, in the examples shown in the figures, the displacement direction of the actuator device 50 is advantageously approximately perpendicular to the direction in which the fluid is sprayed through the dispenser orifice 45, it being understood that as a function of the embodiment selected for the actuator device, and in particular when it is a pivoting element, said direction is not always exactly perpendicular.

In the example shown in FIG. 1, the actuator system 50 includes at least one actuator element 51 pivotally mounted on the dispenser head 40. The dispenser head 40 preferably includes a lateral skirt 41 provided with two diametrally opposite actuator elements 51.

In the invention, the actuator elements 51 acts directly on the fixing ring 30 of the pump 20 on the reservoir 10 in order to actuate said pump or valve. The user therefore places the dispenser head 40 in a nostril, and actuates the elements 51 in order to dispense a dose of fluid, said actuation being performed laterally so that the device remains stationary inside the nostril while dispensing, with no axial force being exerted on the device. The actuator elements 51 are pivotally mounted on the dispenser head 40, each actuator element 51 including an actuator portion 52 which co-operates with the fixing ring 30. Each actuator element 51 advantageously includes a presser element 54 on which the user presses in order to actuate the device. The presser element 54 is preferably connected to the actuator portion 52 of the actuator element 51 via a connection spacer 53 that is preferably rigid. When the user presses on the presser elements 54, force is transmitted directly to the actuator portions 52, and therefore to the fixing ring 30, via said spacers 53. The pivoting of the actuator element 51 about its pivot axis A causes the axial displacement of said fixing ring 30, and therefore the actuation of the pump 20. Another pivot axis could optionally be provided, e.g. between the actuator element 51 and the presser element 54, or even between the presser element 54 and the connection spacer 53. The actuator element 51 and the presser element 54 can thus be made integrally as a single piece.

Advantageously, a precompression element can be provided which enables the pump or the valve 20 to be actuated only when the precompression threshold is overcome by the user. This ensures that the entire dose is dispensed, and prevents the device from being partially actuated.

FIG. 4 shows another embodiment, in which the actuator device includes an actuator element 51 and a movable intermediate piece 58. The actuator element 51 is pivotally mounted on the head 40 about its pivot axis A. It co-operates with the intermediate piece 58, referred to as an "angled part" comprising two branches, one of which is connected to the head 40 (which in this case extends laterally along the reservoir 10), and the other is connected directly to the fixing ring 30. The angled part 58 is also deformable about a pivot axis B so that when the user presses laterally on the actuator element 51, the angled part 58 deforms, with the two branches pivoting about the axis B, thereby causing the ring 30, and thus also the reservoir 10, to move axially, and causing the pump 20 to be actuated.

In the example in FIGS. 3*a* and 3*b*, the actuator device 50 is made in the form of buttons 56 that are laterally displaceable, said displacement actuating the pump or the valve 20. More precisely, in the example in FIG. 3*a*, a rod 57 is pivotally connected to the actuator buttons 56, said rod 57 being guided by an oblique/sloping surface, so that actuation of the buttons 56 causes said rod to move vertically upwards in order to actuate the pump, the end of said rod being fixed, or co-operating with the fixing ring 30 of the device.

FIG. 2 shows another embodiment of the invention, in which the actuator system is formed by the lateral skirt 41 of the dispenser head 40. As shown in FIG. 2, said fixing ring 30 advantageously includes an oblique cam element 31 which co-operates with the bottom end 50 of the lateral skirt 41 of the dispenser head 40, so that displacement of said skirt 41 transversely to the direction in which the fluid is sprayed is transformed by the oblique cam element 31 into displacement in the direction in which the fluid is sprayed. In the device in FIG. 2, the actuator rod of the pump 20 is displaced by actuating the dispenser head 40. It is thus advantageous for the cam element 31 of the fixing ring 30 to co-operate with the bottom end 50 of the lateral skirt 41 of the dispenser head 40 at the end of the actuating stroke of said dispenser head 40.

A particular advantage of a laterally-actuated system that is formed on the head, and that does not co-operate directly with the tank, is that it can be adapted to any type, shape, and size of reservoir. It is not necessary to design a specific actuator system for each reservoir.

Naturally all the embodiments are described and shown only in very diagrammatic manner, and other variants could be used to implement the actuator system of the present invention. The invention is therefore not limited to the embodiments shown in the drawings, and the person skilled in the art can carry out any necessary modifications without going beyond the ambit of the invention as defined by the accompanying claims.

The invention claimed is:

1. A fluid spray device comprising:

a reservoir that contains fluid;

a fixing ring mounted on the reservoir, wherein the fixing ring does not move with respect to the reservoir;

a pump or a valve mounted on the reservoir by the fixing ring for selectively dispensing the fluid;

a dispenser head comprising a dispenser orifice which dispenses fluid from the dispensing device; and an actuator device that is displaceable between a rest position and a dispensing position;

the actuator device is configured to be on the dispenser head and co-operates directly with the fixing ring in order to actuate the pump or the valve; and the actuator device is further configured to include at least one actuator element pivotally mounted on the dispenser head and at least one actuator portion that co-operates with the fixing ring by directly contacting the fixing ring, wherein the actuator device is displaced in a direction that is different from the direction in which the fluid is sprayed through the dispenser orifice.

2. A device according to claim 1, in which said dispenser head (40) includes a lateral skirt (41), said actuator device (50) being formed in said lateral skirt (41).

3. A device according to claim 2, in which the fixing ring (30) includes an oblique cam element (31) co-operating with the bottom end (50) of the lateral skirt (41) of the dispenser head (40), so that displacement of said skirt (41) transversely to the direction in which the fluid is sprayed is transformed by said oblique cam element (31) into displacement in the direction in which the fluid is sprayed.

4. A device according to claim 3, in which the cam element (31) is provided at the end of the actuating stroke of the dispenser head (40).

5. The fluid spray device of claim 2, wherein the at least one actuator portion directly contacts the fixing ring at an outer peripheral portion of the fixing ring.

6. The fluid spray device of claim 2, wherein the lateral skirt is integrally formed on the dispenser head, such that the dispenser orifice does not move with respect to the lateral skirt.

7. The fluid spray device of claim 2, wherein the lateral skirt surrounds the fixing ring.

8. A device according to claim 1, in which each actuator element (51) includes a presser element (54) on which the user exerts an actuation force, said presser element being connected to said actuator portion (52) of the actuator element (51) via a connection spacer.

9. A device according to claim 1, in which said actuator device (50) includes two actuator elements (51) that are diametrally opposite about said dispenser head (40).

10. A fluid spray device according to claim 1, wherein the actuator device is made in the form of one or more buttons co-operating with said fixing ring, said buttons being displaceable in a direction that is approximately perpendicular to the displacement direction of the actuator rod of the pump or of the valve member of the valve.

11. A device according to claim 1, in which said actuator device (50) includes an actuator element (51) pivotally mounted on said head (40), said actuator element (51) co-operating with an intermediate piece (58) connected firstly to said head (40), and secondly to said ring (30), said intermediate piece (58) being deformable so that said ring (30) can be displaced axially relative to said head (40) during actuation.

12. A device according to claim 1, in which said actuator device includes at least one actuator element slidably mounted to slide along the lateral skirt of the dispenser head.

13. A device according to claim 1, in which the actuator device (50) includes a precompression element, so that the pump or the valve (20) is actuated only when the precompression threshold is overcome by the user.

14. A device according to claim 1, in which the dispenser head (40) is a nasal dispenser head, which, during actuation of the pump or the valve (20), remains steady in position in the user's nostril.

15. The fluid spray device according to claim 1, wherein the actuator device movably engages the fixing ring during actuation so as to displace the fixing ring and the reservoir in an axial direction with respect to the dispenser head.

16. The fluid spray device of claim 1, wherein fixing ring comprises:

a cylindrical portion for engaging the reservoir; and a lateral portion extending from the cylindrical portion in a direction that is transverse to the direction of displacement of the pump or valve;

wherein the at least one actuator portion directly contacts the lateral portion of the fixing ring.

17. The fluid spray device of claim 1, wherein the fixing ring comprises a one-piece integral construction.

18. A fluid spray device comprising:

a reservoir comprising fluid;

a pump or a valve for selectively dispensing the fluid, the pump or valve mounted on the reservoir with a fixing ring;

a dispenser head comprising a dispenser orifice and an integrally formed lateral skirt, wherein the dispenser orifice does not move with respect to the lateral skirt;

an actuator pivotally mounted on the lateral skirt, wherein the actuator is displaceable between a rest position and a dispensing position, the actuator displaceable in a direction that is different from the direction in which the fluid is sprayed through the dispenser orifice; and wherein the actuator actuates the pump or the valve by directly contacting the fixing ring at an outer peripheral portion of the fixing ring and displacing the combined fixing ring, pump or valve, and reservoir with respect to the dispenser head and the integrally formed lateral skirt.

19. The fluid spray device according to claim 18, wherein the fixing ring comprises a cam surface and the actuator engages the cam surface of the fixing ring to actuate the pump or the valve.

20. The fluid spray device of claim 18, wherein the lateral skirt surrounds the fixing ring.

21. The fluid spray device of claim 18, wherein fixing ring comprises:

a cylindrical portion for engaging the reservoir; and a lateral portion extending from the cylindrical portion in a direction that is transverse to the direction of displacement of the pump or valve;

wherein the actuator directly contacts the lateral portion of the fixing ring.

22. The fluid spray device of claim 18, wherein the fixing ring comprises a one-piece integral construction.

* * * * *